US006848417B2

(12) United States Patent
Surnilla et al.

(10) Patent No.: US 6,848,417 B2
(45) Date of Patent: Feb. 1, 2005

(54) LEAN IDLE SPEED CONTROL USING FUEL AND IGNITION TIMING

(75) Inventors: Gopichandra Surnilla, West Bloomfield, MI (US); Hans Buus Gangwar, Livonia, MI (US); Stephen B. Smith, Livonia, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 192 days.

(21) Appl. No.: 10/248,530

(22) Filed: Jan. 27, 2003

(65) Prior Publication Data

US 2004/0144360 A1 Jul. 29, 2004

(51) Int. Cl.[7] ..... F02D 1/00

(52) U.S. Cl. ..... 123/339.11; 123/339.19; 123/339.12; 123/339.24

(58) Field of Search ..... 123/339.11, 339.12, 123/339.19, 339.24

(56) References Cited

U.S. PATENT DOCUMENTS 5,483,795 A 1/1996 Katoh et al.
5,839,410 A * 11/1998 Suzuki et al. ..... 123/339.12
6,152,105 A * 11/2000 Nishimura et al. .... 123/339.11
6,209,517 B1 * 4/2001 Yasui ..... 123/339.11
6,295,966 B1 * 10/2001 Ishii ..... 123/339.11
6,349,700 B1 * 2/2002 Buckland et al. ..... 123/339.19
6,550,449 B2 * 4/2003 Akazaki et al. ..... 123/339.11

FOREIGN PATENT DOCUMENTS

EP 0598917 B1 9/1999

* cited by examiner

*Primary Examiner*—Mahmoud Gimie
*Assistant Examiner*—Arnold Castro
(74) *Attorney, Agent, or Firm*—Allan J. Lippa

(57) ABSTRACT

A method is presented for idle speed control of a lean burn spark ignition internal combustion engine using a fuel-based control strategy. In particular, the idle speed control strategy involves using a combination of fuel quantity or timing and ignition timing to achieve desired engine speed or torque while maintaining the air/fuel ratio more lean than prior art systems. Depending on engine operating conditions, the fuel quantity or timing is adjusted to give a more rich air/fuel ratio in order to respond to an engine speed or torque demand increase. Additionally, due to operation close to the lean misfire limit, the spark ignition timing is adjusted away from MBT in response to an engine speed or torque demand decrease. The advantages of this fuel based control system include better fuel economy as well as fast engine response time due to the use of fuel quantity or timing and ignition timing to control engine output.

13 Claims, 13 Drawing Sheets

LEAN IDLE SPEED CONTROL USING FUEL AND IGNITION TIMING

BACKGROUND OF INVENTION

1. Field of the Invention

The present invention relates to idle speed control of lean burn internal combustion engines, and more particularly to lean burn spark ignition engines.

2. Background of the Invention

Lean burn engine systems typically operate at a lean air/fuel ratio significantly lower than the lean misfire limit. This is primarily due to a need to maintain a reserve capacity when controlling fuel injection in response to a load increase. This is especially true for idle speed control for lean burn engines, which is typically accomplished by controlling the fuel quantity/timing and/or the airflow.

One approach for controlling engine idle speed is described in U.S. Pat. No. 6,349,700. In this example, engine/speed control of a direct injection spark ignition engine is accomplished using fuel as a primary torque actuator and airflow as a secondary torque actuator whenever possible to maintain spark near MBT. Fuel is used as the primary torque actuator rather than spark because engine operation is not limited to a narrow range of stoichiometry. When air/fuel ratio limits prohibit the control of torque using fuel, airflow control is used as the torque actuator. Throughout operation, spark is maintained substantially at MBT to enhance fuel economy.

The inventors herein have recognized disadvantages with such a method for engine idle speed control. First, controlling fuel quantity or timing as the primary control for a lean burn engine system results in operation well below the air/fuel ratio lean misfire limit due to the reserve capacity. This reserve capacity can result in decreased fuel economy since operation can occur at a lean air/fuel ratio less lean than otherwise may be possible. Further, engine idle speed control using airflow as the torque control may result in slow engine response.

SUMMARY OF INVENTION

In one example, the above disadvantages of prior approaches are overcome by a method for controlling a lean burn engine, the method comprising: calculating a desired engine speed; operating more lean than a first predetermined lean air-fuel ratio and producing an engine output; increasing the engine output to maintain the desired engine speed by operating less lean than the first air-fuel ratio; and decreasing the engine output to maintain the desired engine speed by operating more lean than the first lean air-fuel ratio and retarding ignition timing from a preselected timing.

By increasing engine output via enriching the air-fuel ratio, it is possible to obtain faster engine response than by using airflow adjustments, while at the same time operating at optimal ignition timing. On the other hand, by decreasing engine output via ignition timing retard, it is possible to increase overall operating time closer to a lean misfire limit air-fuel ratio, while still providing quick output control action. I.e., the engine can operate with a smaller margin (or reserve capacity) between the lean operation air-fuel ratio and the lean misfire limit since large decreases in engine output are accomplished primarily by retarding ignition timing. Further, when engine output conditions are met, lean air/fuel ratio operation is restored by an air adjustment increase. Similarly, the optimal ignition timing is restored with an air adjustment decrease.

Additionally, by operating more lean during most of the engine operating time, the negative effects on fuel economy of retarding ignition timing away from MBT can be overcome.

The present invention thus provides a method for operating an engine at a more lean air/fuel ratio than is possible when both an increase and decrease in engine output are accomplished by fuel quantity or timing.

BRIEF DESCRIPTION OF DRAWINGS

FIGS. 14A–15 show a high level flow chart for controlling engine output and engine speed according to the present invention.

DETAILED DESCRIPTION

Figure 1A:
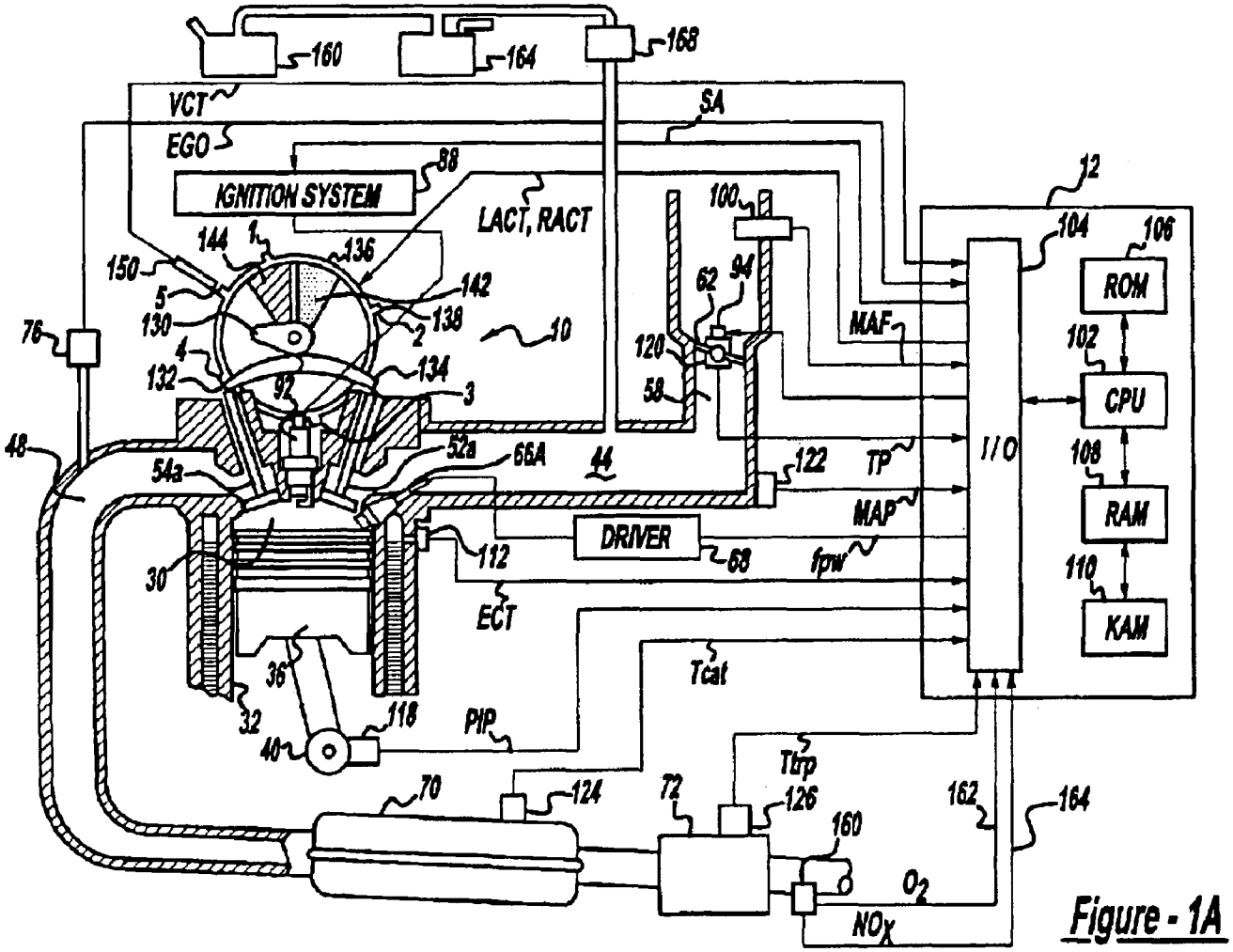
FIGS. 1A and 1B show a partial engine view.
Figure 1B:
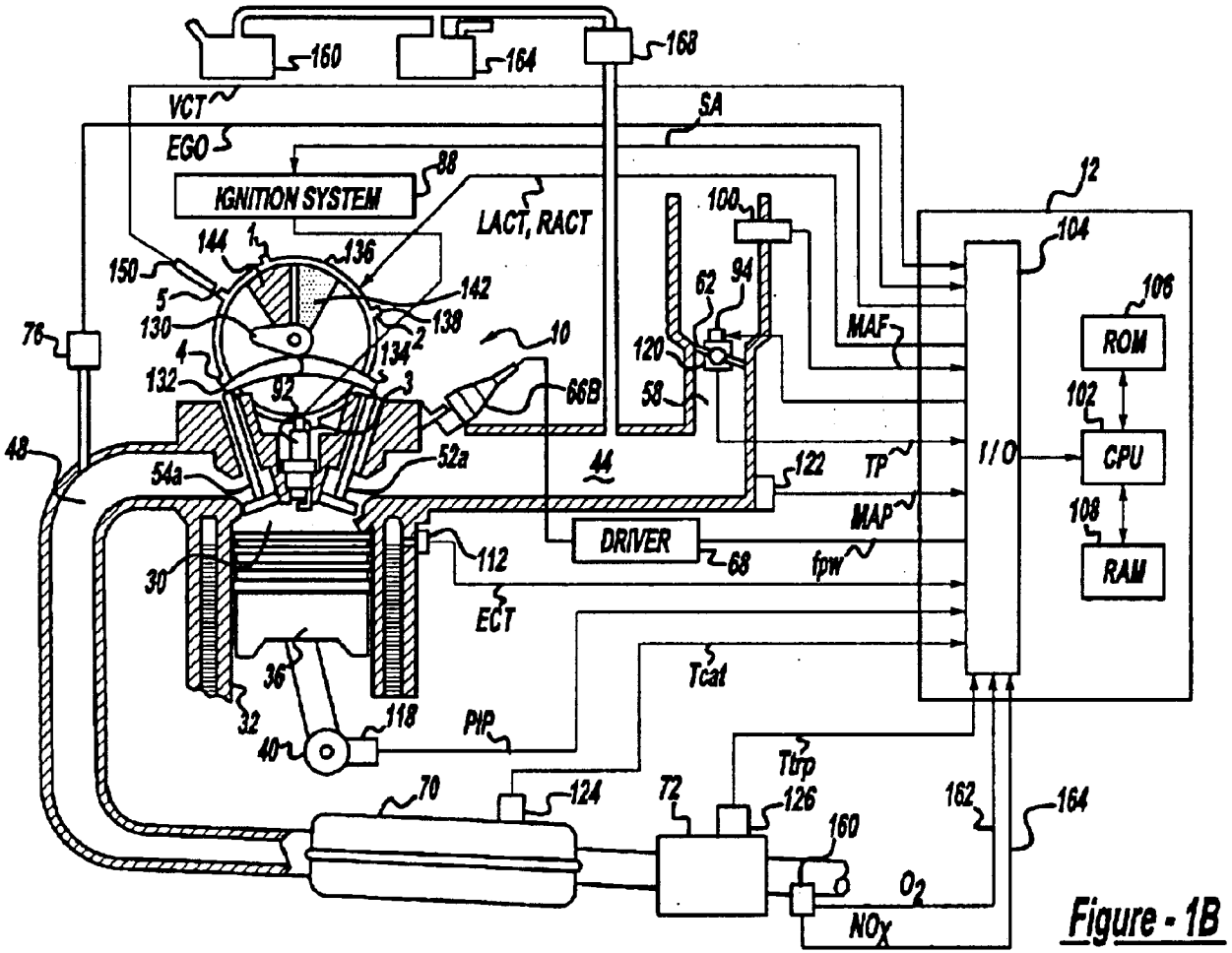

FIGS. 1A and 1B show one cylinder of a multi-cylinder DISI engine, the intake and exhaust path connected to that cylinder as well as the electronic engine control system. Direct injection spark ignited internal combustion engine 10, comprising a plurality of combustion chambers, is controlled by electronic engine controller 12. Engine 10 includes combustion chamber 30 and chamber walls 32 with piston 36 positioned therein and connected to crankshaft 40. A starter motor (not shown) is coupled to crankshaft 40 via a flywheel (not shown). Combustion chamber, or cylinder, 30 communicates with intake manifold 44 and exhaust manifold 48 via respective intake valves 52*a* and 52*b* (not shown), and exhaust valves 54*a* and 54*b* (not shown). Fuel injector 66A is shown directly coupled to combustion chamber 30 for delivering injected fuel directly therein in proportion to the pulse width of signal fpw received from controller 12 via conventional electronic driver 68. Fuel is delivered to fuel injector 66A by a conventional high-pressure fuel system (not shown) including a fuel tank, fuel pumps, and a fuel rail.

Intake manifold 44 is shown communicating with throttle body 58 via throttle plate 62. Throttle plate 62 is coupled to electric motor 94, which receives a signal from an electronic driver. The electronic driver receives control signal (DC) from controller 12. This configuration is commonly referred to as electronic throttle control (ETC), which is also utilized during idle speed control. In an alternative embodiment (not shown), which is well known to those skilled in the art, a bypass air passageway is arranged in parallel with throttle plate 62 to control inducted airflow during idle speed control via a throttle control valve positioned within the air passageway.

Exhaust gas sensor 76 is shown coupled to exhaust manifold 48 upstream of catalytic converter 70 (note that sensor 76 corresponds to various different sensors, depending on the exhaust configuration. For example, it could correspond to sensor 230, or 234, or 230*b*, or 230*c*, or 234*c*, or 230*d*, or 234*d*, as described in later herein with reference to FIG. 2). Sensor 76 (or any of sensors 230, 234, 230*b*,

230*c*, 230*d*, or 234*d*) may be any of many known sensors for providing an indication of exhaust gas air/fuel ratio such as a linear oxygen sensor, a two-state oxygen sensor, or an HC or CO sensor. In this particular example, sensor 76 is a two-state oxygen sensor that provides signal EGO to controller 12 which converts signal EGO into two-state signal EGOS. A high voltage state of signal EGOS indicates exhaust gases are rich of stoichiometry and a low voltage state of signal EGOS indicates exhaust gases are lean of stoichiometry. Signal EGOS is used to advantage during feedback air/fuel control in a conventional manner to maintain average air/fuel at stoichiometry during the stoichiometric homogeneous mode of operation.

Engine 10 further includes conventional distributorless ignition system 88 to provide ignition spark to combustion chamber 30 via spark plug 92 in response to spark advance signal SA from controller 12. In the embodiment described herein, controller 12 is a conventional microcomputer including: microprocessor unit 102, input/output ports 104, electronic memory chip 106, which is an electronically programmable memory in this particular example, random access memory 108, keep alive memory 110, and a conventional data bus.

Controller 12 is shown receiving various signals from sensors coupled to engine 10, including measurement of inducted mass air flow (MAF) from mass air flow sensor 100 coupled to throttle body 58; engine coolant temperature (ECT) from temperature sensor 112 coupled to cooling sleeve 114; a profile ignition pickup signal (PIP) from Hall effect sensor 118 coupled to crankshaft 40; throttle position TP from throttle position sensor 120; and absolute Manifold Pressure Signal MAP from sensor 122. Engine speed signal RPM is generated by controller 12 from signal PIP in a conventional manner and manifold pressure signal MAP from a manifold pressure sensor provides an indication of vacuum, or pressure, in the intake manifold.

Continuing with FIG. 1A, in response to signal fpw, fuel injector 66A injects an appropriate quantity of fuel in one or more injections directly into each combustion chamber 30. Operating conditions of the engine in which fuel quantity or timing changes may be useful are when greater engine speed is desired, greater torque is desired, or a load increase demand is placed on the engine.

Controller 12 also sends spark advance signal SA to spark plug 92 via conventional distributorless ignition system 88. For example, in response to signal SA, spark plug 92 retards timing away from MBT thereby decreasing the produced engine torque and reducing engine speed to the desired level.

Nitrogen oxide (NOx) adsorbent or trap 72 is shown positioned downstream of catalytic converter 70. NOx trap 72 is a three-way catalyst that absorbs NOx when engine 10 is operating lean of stoichiometry. The absorbed NOx is subsequently reacted with HC and CO and catalyzed when controller 12 causes engine 10 to operate in either a rich homogeneous mode or a near stoichiometric homogeneous mode such operation occurs during a NOx purge cycle when it is desired to purge stored NOx from NOx trap 72, or during a vapor purge cycle to recover fuel vapors from fuel tank 160 and fuel vapor storage canister 164 via purge control valve 168, or during operating modes requiring more engine power, or during operation modes regulating temperature of the omission control devices such as catalyst 70 or NOx trap 72.

Continuing with FIG. 1A, camshaft 130 of engine 10 is shown communicating with rocker arms 132 and 134 for actuating intake valves 52*a*, 52*b* and exhaust valve 54*a*, 54*b*. Camshaft 130 is directly coupled to housing 136. Housing 136 forms a toothed wheel having a plurality of teeth 138. Housing 136 is hydraulically coupled to an inner shaft (not shown), which is in turn directly linked to camshaft 130 via a timing chain (not shown). Therefore, housing 136 and camshaft 130 rotate at a speed substantially equivalent to the inner camshaft. The inner camshaft rotates at a constant speed ratio to crankshaft 40. However, by manipulation of the hydraulic coupling as will be described later herein, the relative position of camshaft 130 to crankshaft 40 can be varied by hydraulic pressures in advance chamber 142 and retard chamber 144. By allowing high-pressure hydraulic fluid to enter advance chamber 142, the relative relationship between camshaft 130 and crankshaft 40 is advanced. Thus, intake valves 52*a*, 52*b*, and exhaust valves 54*a*, 54*b*, open and close at a time earlier than normal relative to crankshaft 40. Similarly, by allowing high-pressure hydraulic fluid to enter retard chamber 144, the relative relationship between camshaft 130 and crankshaft 40 is retarded. Thus, intake valves 52*a*, 52*b*, and exhaust valves 54*a*, 54*b*, open and close at a time later than normal relative to crankshaft 40.

Teeth 138, being coupled to housing 136 and camshaft 130, allow for measurement of relative cam position via cam timing sensor 150 providing signal VCT to controller 12. Teeth 1, 2, 3, and 4 are preferably used for measurement of cam timing and are equally spaced (for example, in a V-8 dual bank engine, spaced 90 degrees apart from one another) while tooth 5 is preferably used for cylinder identification, as described later herein. In addition, controller 12 sends control signals (LACT, RACT) to conventional solenoid valves (not shown) to control the flow of hydraulic fluid either into advance chamber 142, retard chamber 144, or neither.

Relative cam timing is measured using the method described in U.S. Pat. No. 5,548,995, which is incorporated herein by reference. In general terms, the time, or rotation angle between the rising edge of the PIP signal and receiving a signal from one of the plurality of teeth 138 on housing 136 gives a measure of the relative cam timing. For the particular example of a V-8 engine, with two cylinder banks and a five-toothed wheel, a measure of cam timing for a particular bank is received four times per revolution, with the extra signal used for cylinder identification.

Sensor 160 provides an indication of both oxygen concentration in the exhaust gas as well as NOx concentration. Signal 162 provides controller a voltage indicative of the O2 concentration while signal 164 provides a voltage indicative of NOx concentration.

Referring now to FIG. 1B, a port fuel injection configuration is shown where fuel injector 66B is coupled to intake manifold 44, rather than directly cylinder 30.

Also, in each embodiment of the present invention, the engine is coupled to a starter motor (not shown) for starting the engine. The starter motor is powered when the driver turns a key in the ignition switch on the steering column, for example. The starter is disengaged after engine start as evidence, for example, by engine 10 reaching a predetermined speed after a predetermined time. Further, in each embodiment, an exhaust gas recirculation (EGR) System routes a desired portion of exhaust gas from exhaust manifold 48 to intake manifold 44 via an EGR valve (not shown). Alternatively, a portion of combustion gases may be retained in the combustion chambers by controlling exhaust valve timing.

As described above, FIGS. 1A and 1B merely show one cylinder of a multi-cylinder engine, and each cylinder has its own set of intake/exhaust valves, fuel injectors, spark plugs, etc.

Feedback from exhaust gas oxygen sensors can be used for controlling air/fuel ratio during lean operation. In particular, a switching type, heated exhaust gas oxygen sensor (HEGO) can be used for stoichiometric air/fuel ratio control by controlling fuel injected (or additional air via throttle or VCT) based on feedback from the HEGO sensor and the desired air/fuel ratio. Further, a UEGO sensor (which provides a substantially linear output versus exhaust air/fuel ratio) can be used for controlling air/fuel ratio during lean and stoichiometric operation. In this case, fuel injection (or additional air via throttle or VCT) is adjusted based on a desired air/fuel ratio and the air/fuel ratio from the sensor. Further still, individual cylinder air/fuel ratio control could be used if desired.

The inventors herein propose controlling engine idle speed using fuel as a fast torque actuator when current engine operating conditions permit. The desired fuel flow or fuel timing is modified to provide speed control using appropriate signals generated by controller 12. In addition, ignition-timing adjustments are also used. Such operation is described more fully below herein.

Generally, when air/fuel ratio limits prohibit, or constrain, the use of fuel as a torque actuator, spark timing retard is used to produce the desired engine speed. It is more beneficial to change the spark timing away from MBT rather than risk misfires and stalls by running the engine more lean. When engine operating conditions make a fuel timing or quantity change more difficult due to operation beyond the lean misfire limit, and in response to a decrease in load demand, spark ignition timing is retarded to deliver the desired engine speed or torque.

Figure 2:
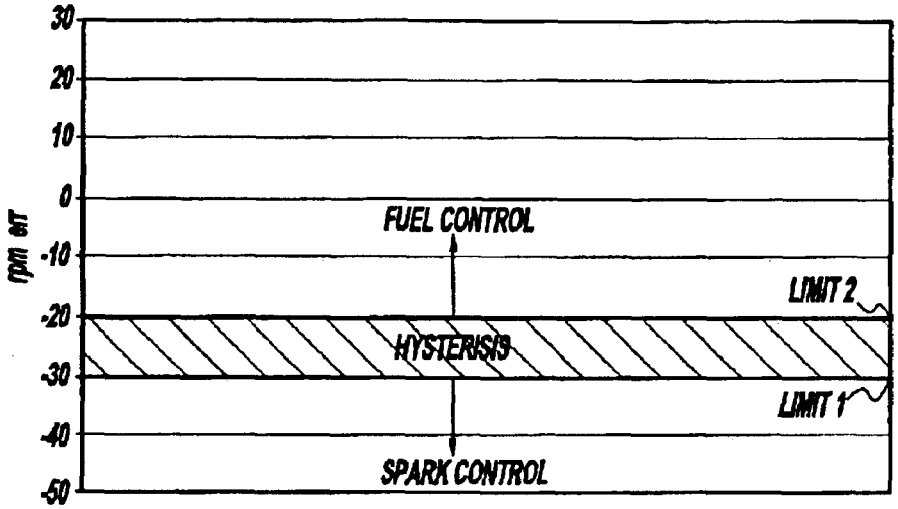
FIG. 2 shows the control action as a function of RPM error according to the present invention.

In one embodiment, controller 12 receives engine speed signal RPM and determines a speed error (rpmerr) measurement based on the difference between the desired rpm and the actual rpm. During operating conditions, typical rpmerr values are +/−20. Referring to FIG. 2, the idle speed engine control strategy for the lean burn engine is shown graphically with respect to rpmerr. This graph illustrates that for an rpmerr below a first limit (in one example 30 RPM), the strategy for controlling rpm errors is primarily based on changes in ignition timing, or spark. However, for rpmerr values greater than 20, a feedback fuel, or air-fuel ratio, controller is active. This fuel, or air/fuel ratio, controller is described more fully below herein.

In addition, a 10 rpm hysteresis is introduced to reduce frequent switching between the two spark states. While this example uses 10 RPM, various other values can be used depending on the engine size, A/C load, etc. Furthermore, it is not necessary to control the rpm in the +/−15 bandwidth by fuel control. This is normal deviation from the baseline and is acceptable. Therefore, the gains used can be zero in this error region. This fuel controller is used as a fast response control for engine speed demands. A slower controller can be used to increase the air flow and return the air/fuel ratio to a more lean condition, which in a lean burn engine system can provide a reserve torque supply and takes the place of a reserve torque in this strategy case. Changing from a more lean air/fuel ratio towards stoichiometric provides the needed torque necessary for increased load demands on the engine. This fuel control strategy can be used because of the lean operating condition of the engine. Further, when engine operating conditions prohibit, or constrain, the use of fuel as a torque actuator due to operation at air/fuel ratios too close to the lean misfire limit, spark timing can be adjusted away from MBT to provide the desired decrease in engine output speed or torque.

Figure 9:
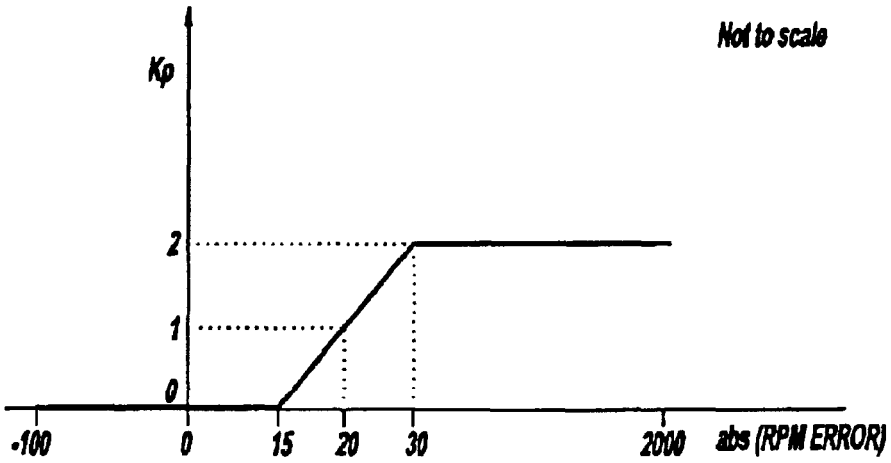
FIGS. 9–12 show graphs and experimental results using the present invention to advantage.

In one particular embodiment, a proportional fuel controller is used. The actual implementation of the proportional fuel controller is:

$$\Delta\lambda = Kp * rpmerr / dsdrpm$$

where:

rpmerr is the desired rpm minus actual rpm of engine 10;

Kp is a function of rpmerr only in this example (See FIG. 9);

dsdrpm is the desired rpm;

$\Delta\lambda$ is the change in lambse, where lambse is defined as actual air/fuel ratio divided by the stoichiometric value (e.g., 14.7). Note also that the desired air-fuel ratio (lambse) can be determined on a per bank basis if the engine has multiple banks. Similarly, the fuel adjustment ($\Delta\lambda$, or fbf_delta), can be determined on a per bank basis if the two banks are operating at different desired air-fuel ratios. Further, if one bank is operating without injected fuel (i.e., in injector cut-out mode), then the fuel adjustment is provided to only some of the engine cylinders.

Here, Kp is normalized inversely with respect to the desired rpm and directly with the rpm error. This is done to provide greater sensitivity at lower rpms, where rpm errors are felt more. Also, the work done by engine 10 in idle is relatively constant. Since:

$$\text{Work Power} = \text{RPM} * \text{Torque},$$

then, for a higher engine speed, less torque is needed. Thus, $\Delta\lambda$ is less at a higher rpm to achieve the desired change in power than it would be at a lower rpm.

The following routines describe the fuel control and other details as well as alternative embodiments and variations of the present invention.

Figure 3:
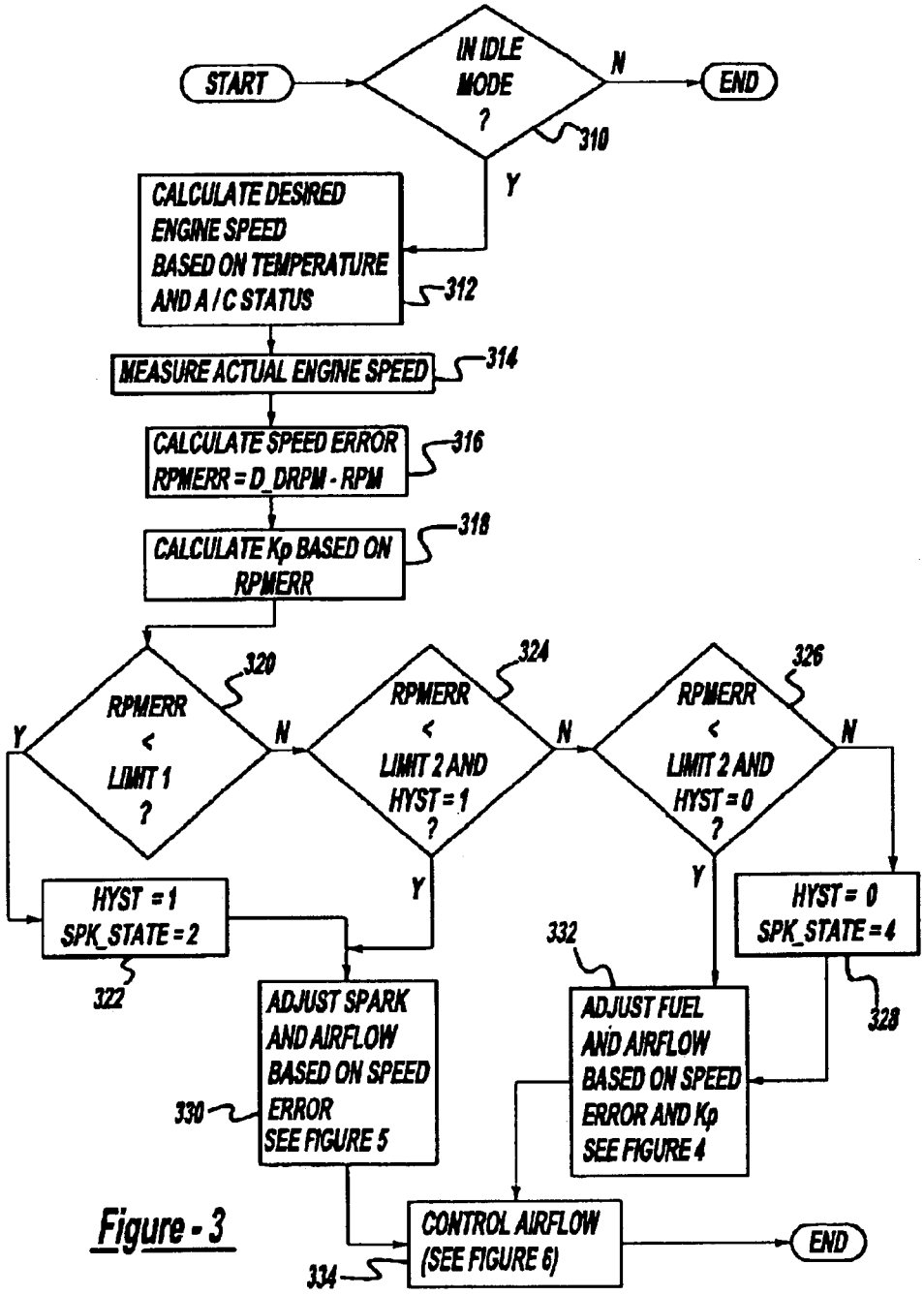
FIGS. 3–8 illustrate operation according to the present invention via high-level flow charts.

Referring now to FIG. 3, a routine is described for managing the idle speed control. First, in step 310, the routine determines whether the engine is in the lean idle speed control state. The lean idle state is selected based on operating conditions, such as time since engine start, engine and external temperature, vehicle speed being less than a threshold, and pedal position (PP) being less than a threshold. When the answer to step 310 is no, the routine exits.

When the answer to step 310 is yes, the routine continues to step 312. In step 312, the routine calculates a desired engine speed based on temperature, air conditioning status, gear ratio, and other variables. Typically, a desired speed in the range of 500–1200 RPM is selected. Next, in step 314, the routine measured the actual engine speed (rpm) from the speed sensor. Then, in step 316, the routine calculates a speed error (rpmerr) based on the desired speed (dsd_rpm) and the actual speed (rpm). Then, in step 318, the routine calculates a fuel control gain (Kp) based on speed error, as described with reference to FIG. 9.

Then, in step 320, the routine determines whether the speed error is less than a first limit value (Limit1). In this particular example, the value of Limit1 is approximately 30, although various other values could be used depending on the engine type and operating conditions such as temperature. When the answer to step 320 is yes, the routine sets the hysteresis flag (hyst) to logical 1, and the ignition timing state (spk_state) to 2. When the answer is no, the routine continues to step 324.

In step 324, the routine determines whether the speed error is less than a second limit value (Limit2). In this particular example, the value of Limit1 is approximately 20, although various other values could be used depending on the engine type and operating conditions such as temperature. Generally, Limit2 is greater than Limit1. Further, in step 324, the routine determines whether the hysteresis flag (hyst) is one. If either of these is not true, the routine continues to step 326. In step 326, the routine determines whether the speed error is less than a second limit value (Limit2) and whether the hysteresis flag (hyst) is zero. If either of these is not true, the routine continues to step 328 and sets the flag to zero and the spk_state to 4. In this way, the routine provides a hysteresis zone for switching between using fuel control action and using ignition timing control action.

Continuing with FIG. 3, from either step 322 or a yes response to step 324, the routine adjusts ignition timing based on the speed error to adjust engine output torque as described below herein with regard to FIG. 5. Also, from either step 328 or a yes response to step 326, the routine adjusts fuel based on the speed error to adjust engine output torque as described below herein with regard to FIG. 4. Finally, in step 334, the routine adjusts engine airflow as described below herein with regard to FIG. 6.

Thus, in this way, for small increases or decreases, and for large increases, in engine output (due to small speed errors), fuel is adjusted to provide the change in engine output. However, for large decreases in engine output, ignition-timing retard is used.

Figure 4:
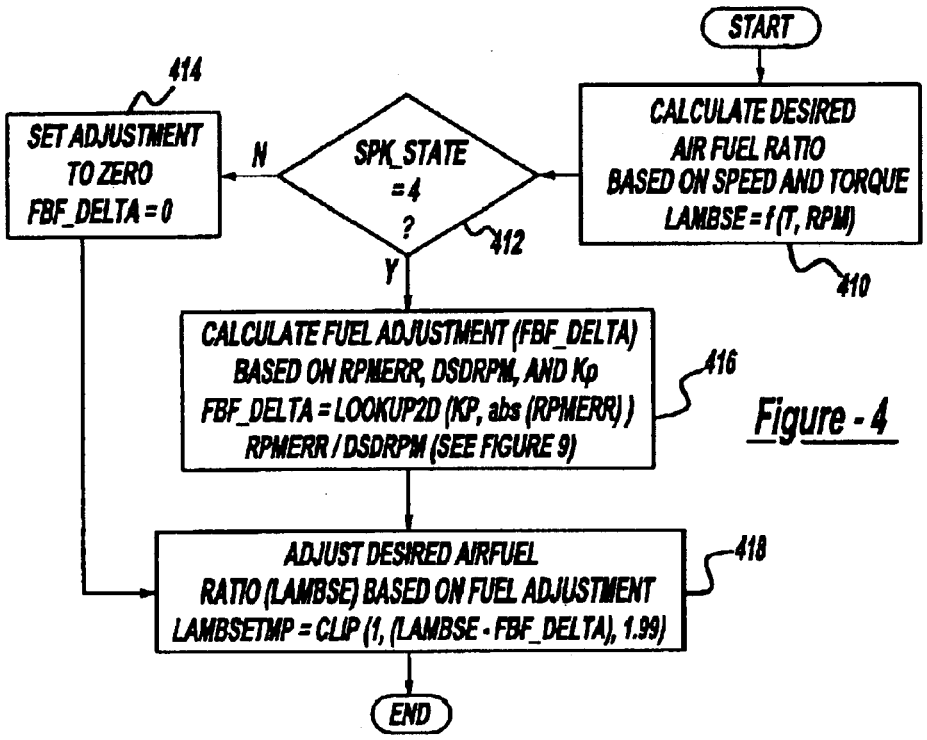

Referring now to FIG. 4, the fuel control is described in more detail. First, in step 410, the routine calculates the desired air-fuel (lambse) ratio based on the desired engine torque and engine speed. In another example, the desired air/fuel ratio is based on other operating conditions such as wheel torque, vehicle speed, and gear ratio. Still other variations can be used to determine the desired air/fuel ratio such as temperature and engine combustion mode.

Next, in step 412, the routine determines whether the spk_state is 4. When the answer is no, the routine continues to step 414 and sets the idle speed control fuel feedback adjustment (fbf_delta) to zero. When the answer is yes to step 412, the routine continues to step 416. In step 416, the routine calculates the fuel adjustment (fbf_delta) based on the equation below:

$$fbf_delta = Kp*(rpmerr/dsdrpm)$$

where:

Kp is determined from the absolute value of the speed error (rpmerr) as shown in FIG. 9.

Then, from either step 414 or 416, the routine continues to step 418 where the routine adjusts the desired air-fuel ratio (lambse) based on the fuel adjustment as:

$$lambse_tmp = CLIP(1.0, (lambse\ fbf_delta), 1.99).$$

Here, the CLIP routine keeps the value of (lambse fbf_delta) between 1 and 1.99. Various other clip values can be used to keep the requested air-fuel ratio within acceptable limits for engine combustion.

Figure 5:
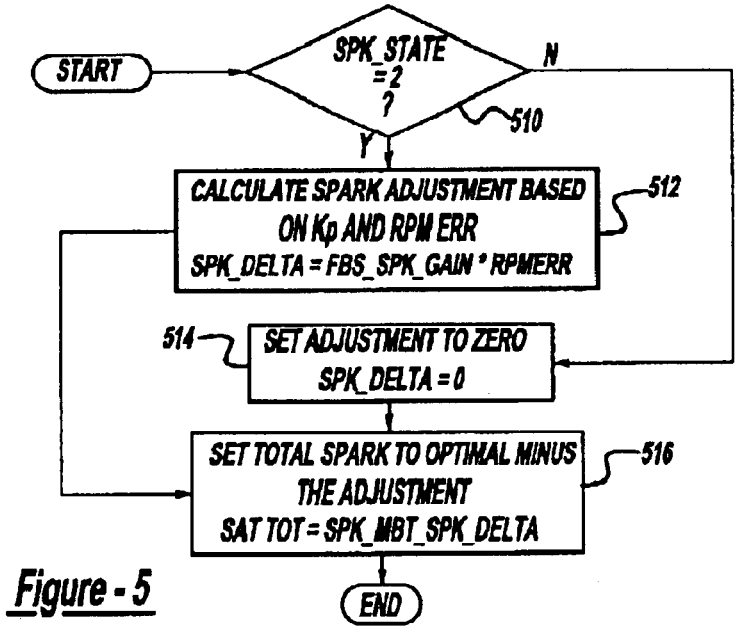

Referring now to FIG. 5, the ignition-timing controller is described. First, in step 510, the routine determines whether spk_state is 2. When the answer to step 510 is yes, the routine continues to step 512 where a spark adjustment (spk_delta) is calculated based on a feedback gain (fbs_spk_gain) and the speed error (rpmerr). Otherwise, when the answer to step 510 is no, the routine continues to step 514 where the spark adjustment (spk_delta) is set to zero. From either step 514 or 512, the routine proceeds to step 516 to set the total requested ignition timing (saf_tot) to the optimal timing (MBT) minus the spark adjustment.

In this way, when fuel, and air, are used to control speed error, ignition timing can be set to the optimal value to improve fuel economy. Further, when fuel reaches a limit value due to the misfire limit, engine torque can be decreased by adjusting ignition timing away from the pre-selected value, which is MBT timing in this example.

Figure 6:
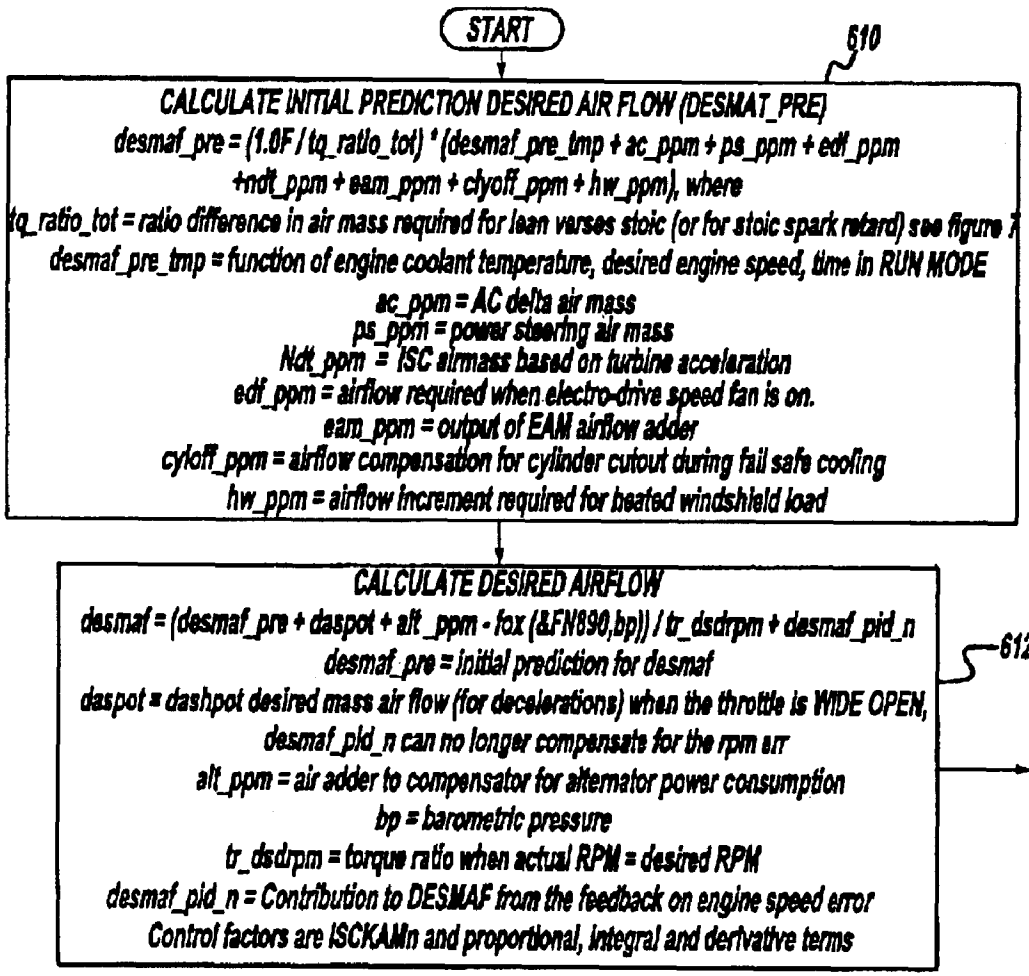
Figure 7:
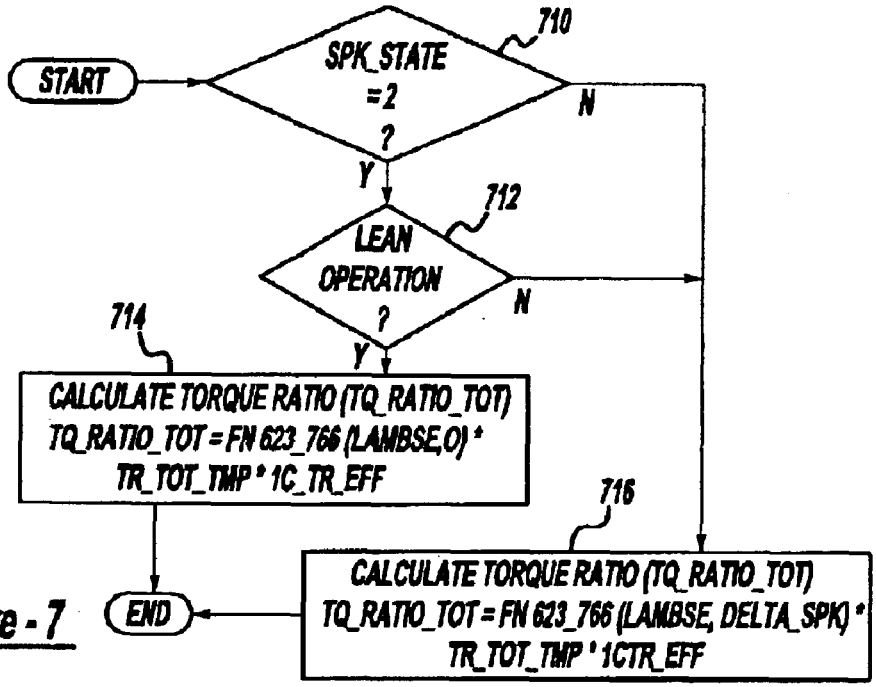
Figure 8:
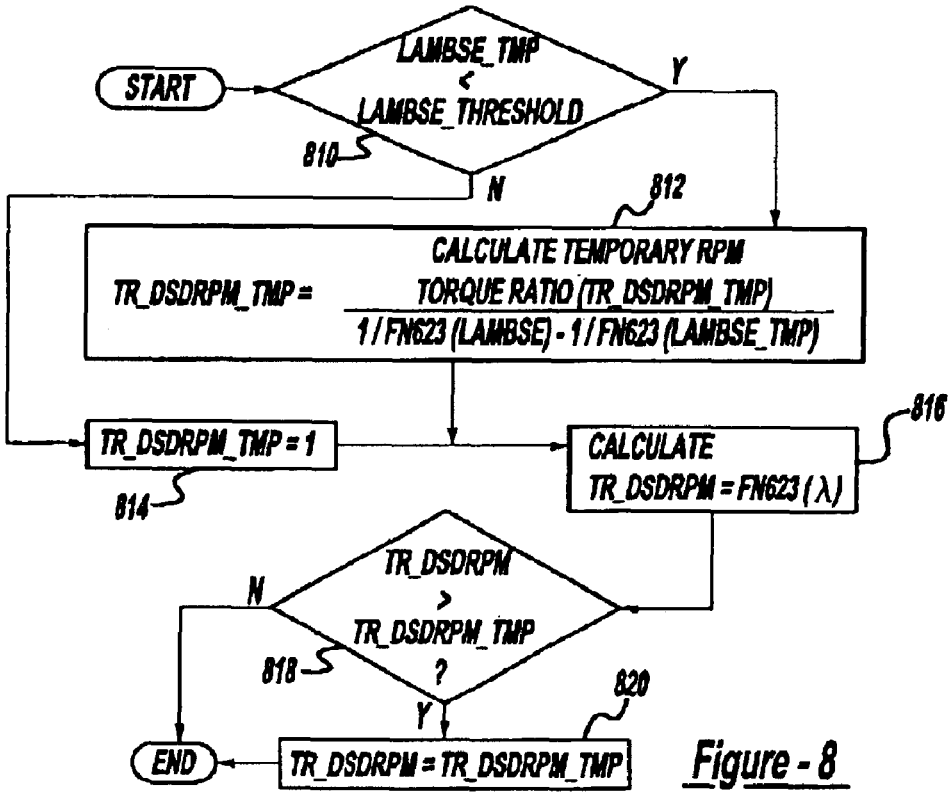

Referring now to FIG. 6, the airflow controller is described. Since the airflow control is relatively slow compared to ignition timing and fuel adjustments at lean air-fuel ratios, the airflow control is primarily used to maintain a reserve engine output adjustment margin. In other words, during the lean idle control, reserve air is available to allow increases in fuel, thus providing reserve torque. In order to maintain this reserve air, the air mass is gradually increased or decreased as necessary. FIGS. 6–8 describe one approach to maintain this reserve capacity sufficient to provide accurate control, but small enough to allow increased fuel economy benefits to be achieved.

First, in step 610, the routine determines an initial prediction of the required airflow (desmaf_pre) according to the following equation:

$$desmaf_pre = (1.0F/tq_ratio_tot)*(desmaf_pre_tmp + ac_ppm + ps_ppm + edf_ppm + ndt_ppm + eam_ppm + clyoff_ppm + hw_ppm)$$

where:

tq_ratio_tot=ratio difference in air mass required for lean verses stoic (or for stoic spark retard)

desmaf_pre_tmp=function of engine coolant temperature, desired engine speed, time in RUN MODE ac_ppm=AC delta air mass ps_ppm=power steering air mass edf_ppm=airflow required when electro-drive speed fan is on Ndt_ppm=ISC airmass adder based on turbine acceleration eam_ppm=output of EAM airflow adder cyloff_ppm=airflow compensation for cylinder cutout during fail safe cooling hw_ppm=airflow increment required for heated windshield load.

Figure 10:
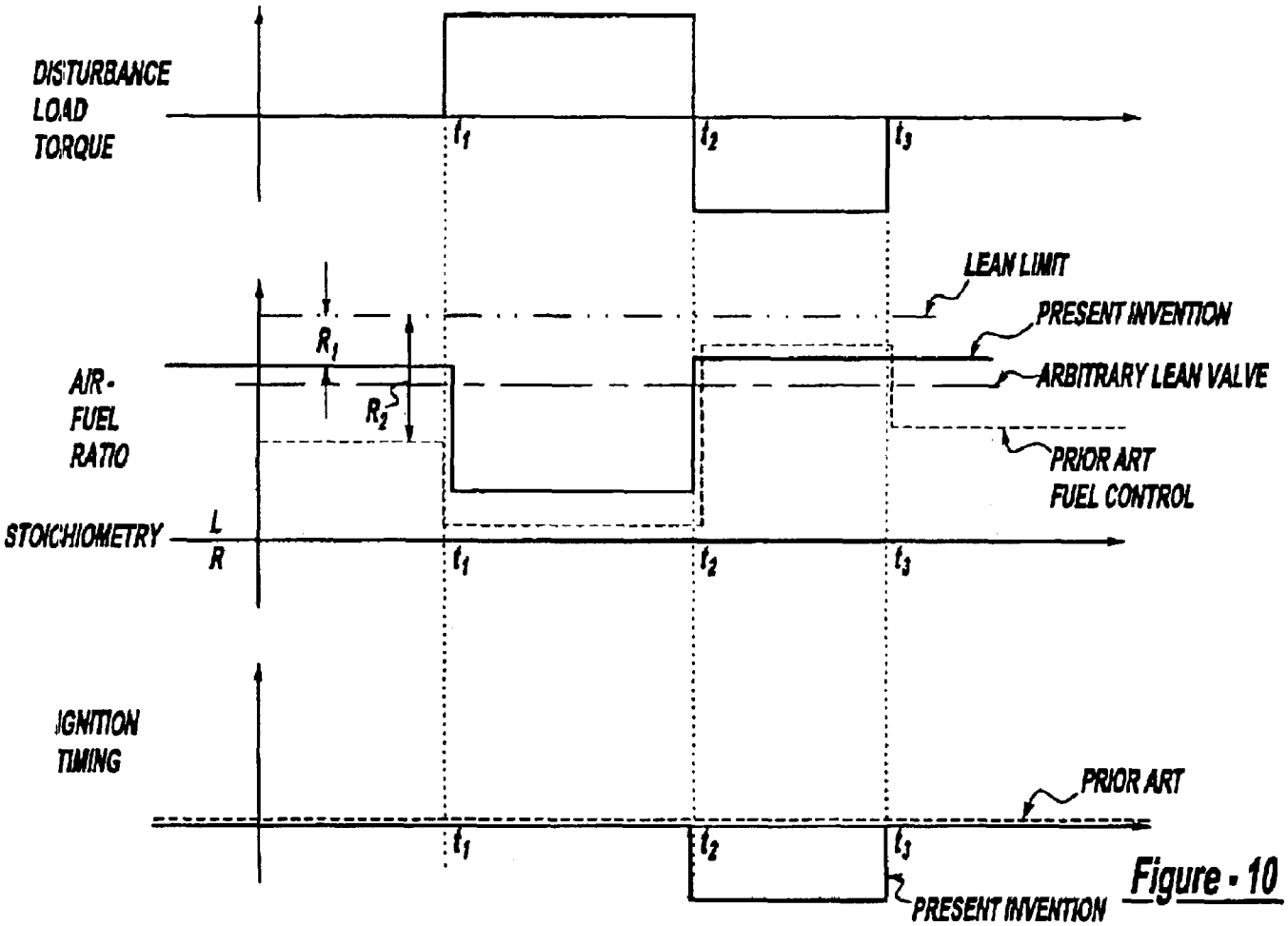
Figure 11:
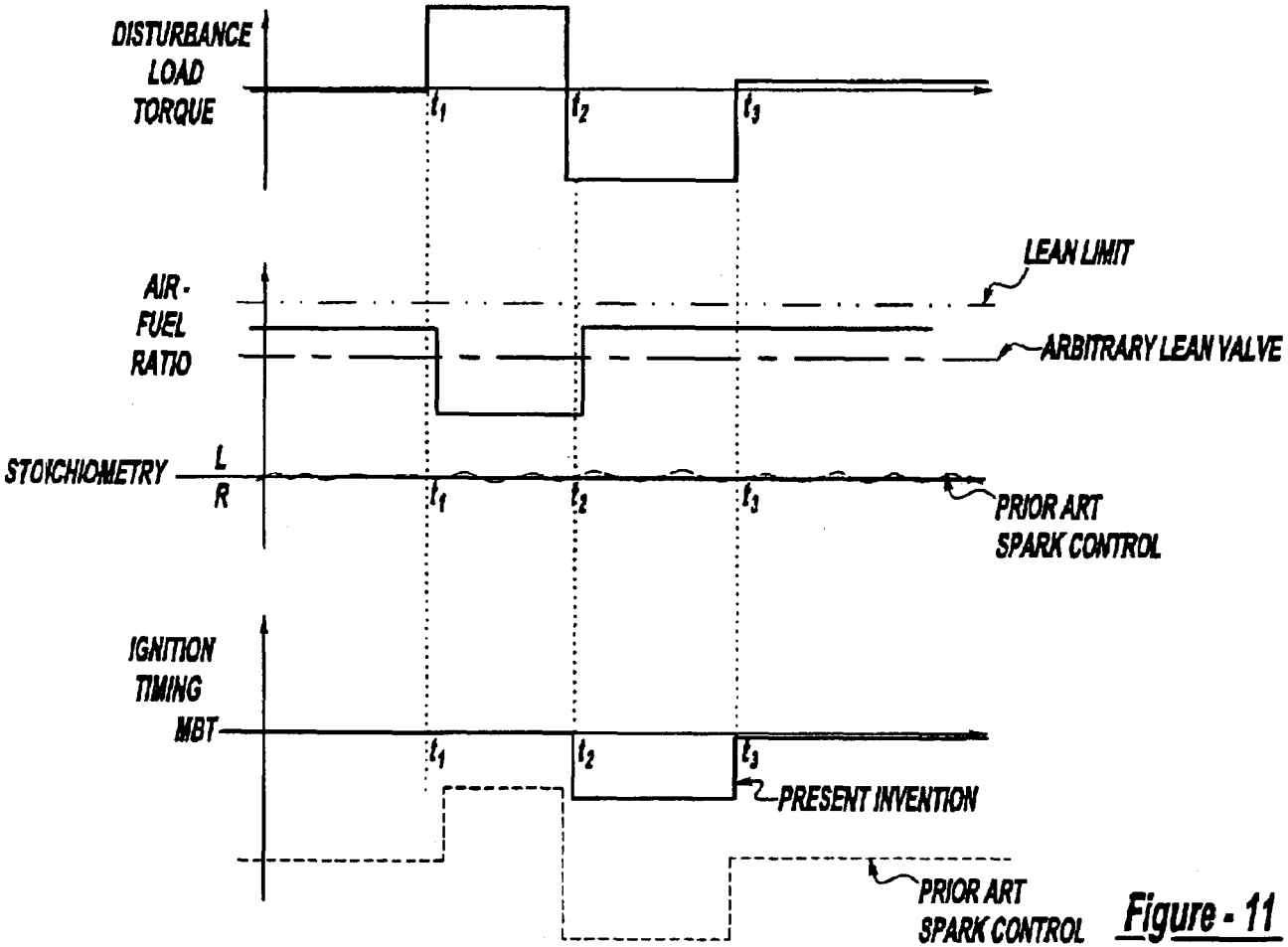

Then, in step 612, the routine calculates the final value of the desired airflow (desmaf):

$$desmaf = (desmaf_pre + daspot + alt_ppm\ FN890(bp))/tr_dsdrpm + desmaf_pid_n$$

where:

desmaf_pre=initial prediction for desmaf daspot=dashpot desired mass air flow (for decelerations) when the throttle is WIDE OPEN, desmaf_pid_n can no longer compensate for the rpm err alt_ppm=air adder to compensator for alternator power consumption bp=barometric pressure tr_dsdrpm=torque ratio when actual RPM=desired RPM. This function returns the amount of airmass needed to return lambse to unity. However, as described below, lambse is not necessarily unity during lean burn control. Therefore, the compensation used in FIGS. 10 and 11 is applied.

desmaf_pid_n=Contribution to DESMAF from the feedback on engine speed error. Control factors are ISCKAMn and proportional, integral and derivative terms.

Referring now to FIG. 7, the calculation for the torque ratio parameter (tq_ratio_tot) is described. First, in step 710, the routine determines whether the spk_state is 2. If so, the routine continues to step 712 to determine whether the engine is currently in lean operation. If either of these answer no, the routine continues to step 716. Otherwise, if each is yes, the routine continues to step 714.

In step 714, the routine calculates the torque ratio using function 623_766. This function is similar to function 623, except that it is a look-up table that also includes the effects of ignition timing retard. Thus, the following equation is utilized:

$$tq_\text{ratio}_tot = fn\mathbf{623}_\mathbf{766}(lambse, 0) * tr_tot_tmp * ic_tr_eff$$

where tr_tot_tmp is a calibration value to compensate for differences in engine types, and ic_tr_eff is a calibration value to compensate for injector cut-out, if it is utilized. In other words, the engine is operating more efficiently during injector cut-out mode, therefore a different torque ratio compensation is needed.

Otherwise, in step 716, the routine calculates the torque ratio as:

$$tq_\text{ratio}_tot = fn\mathbf{623}_\mathbf{766}(lb_des_lmb, delta_spk) * tr_tot_tmp * ic_tr_eff.$$

Referring now to FIG. 8, a routine is described for calculating the speed error torque ratio (tr_dsdrpm) utilized in FIG. 6. First, in step 810, the routine determines whether the adjusted desired air/fuel ratio (lambse_tmp) is less then the difference between the desired air/fuel ratio determined from speed and torque (lambse) minus a threshold value. In this particular case, the threshold is approximately 0.05, in terms of relative air/fuel ratios.

When the answer to step 810 is yes, the routine continues to step 812 to calculate a temporary value of the speed torque ratio (tr_dsdrpm_tmp) as:

$$tr_dsdrpm_tmp = 1/(1/FN\mathbf{623}(lambse) - 1/FN\mathbf{623}(lambse_tmp)).$$

Otherwise, in step 814, this temporary value is set to 1. Then, in step 816, the routine calculates a base value for the speed torque ratio (tr_dsdrpm) as a function of the relative air-fuel ratio measured by an air-fuel sensor (λ).

Then, in step 818, the routine determines whether tr_dsdrpm is greater than the temporary value (tr_dsdrpm_tmp). When the answer is no, the routine ends. When the answer is yes, the routine sets the base value for the speed torque ratio (tr_dsdrpm) to the temporary value in step 820.

Since FN623 returns the amount of air mass needed to return lambse to unity, this routine compensates for any errors generated when the air/fuel ratio is not at unity. So, in order to compensate directly for the difference in actual and desired lambse, the above equations and logic are used.

In the above strategy implementation, the calculated value of tr_dsdrpm is compared to the old value, and whichever is smaller is assigned. This is utilized since the only repository of the additional air mass is tr_dsdrpm. So, whatever fuel is needed in fast response to correct for rpm error, the corresponding amount of air is commanded to return lambse to its desired value. tr_dsdrpm is reset to unity when the spark controller ends. As described above, this spark controller is used for engine speed increases in excess of 30 rpm above the desired value.

Referring now to FIG. 9, a graph is shown illustrating an example calibration of the gain Kp versus speed error. This is simply one example, and various other gains and functions can be used with the present invention depending on the desired response, settling time, steady state error, etc.

FIGS. 10 and 11 illustrate a comparison of the control action according to the present invention compared with prior art approaches. FIG. 10 is a comparison to lean idle fuel and air controllers, whereas FIG. 11 is a comparison to stoichiometric spark and air controllers.

The top graph of FIG. 10 shows the load torque disturbance example value illustrating an increase and decrease in engine load during idle speed control. The middle graph shows the air/fuel ratio traces, and the bottom graph shows the ignition timing traces. The graphs illustrate a load increase at time t1, a load decrease at time t2, and a return to no disturbance at time t3. When no disturbance is present, or when a negative load disturbance is present, the present invention maintains a small air/fuel reserve R1. However, when no disturbance is present, the prior art must maintain a larger reserve R2 since the prior art relies on a decrease in fueling to decrease engine output. Note, also, that the present invention is able to be more lean than an arbitrary lean value during most operation, whereas the prior art must be less lean than this value during most operation.

Thus, while the prior art approach always operates at MBT, it operates less lean most of the time to allow sufficient torque reserve. (Torque disturbances occur only a few percent of the total lean idle time.) Thus, the small gain of always maintaining MBT spark likely will not outweigh the fuel economy loss of operating less lean than possible (R2 compared to R1), i.e., the present invention recognizes that a significant increase in fuel economy is obtained by operating more lean most of the time, with only a minimal sacrifice due to spark retard only a small percentage of the time to counteract decreases in engine load. Stated another way, present invention has a smaller nominal lean air-fuel reserve relative to the lean limit (R1) than the prior art fuel control methods (R2).

FIG. 11 illustrates a comparison of the present invention to prior art methods that operated at stoichiometry. Compared to stoichiometric spark and air approaches, the present invention also has significant advantages. Again, the three graphs illustrate the disturbance, air-fuel ratio, and ignition timing, respectively. Here, the present invention operates most all of the time at MBT and significantly lean, both giving fuel economy benefits. However, the prior art is constantly operating with retarded ignition timing, which translates directly into lost fuel economy.

Figure 12:
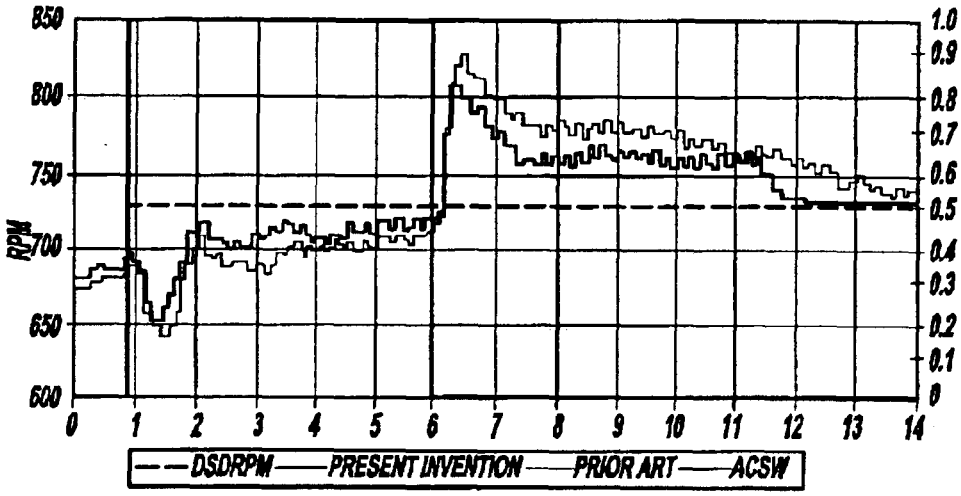

Finally, FIG. 12 illustrates a comparison of the feedback speed control obtained according to the present invention compared with spark control at stoichiometry. As shown, less idle speed control error is achieved, with a projected fuel economy benefit of around 0.5%. In particular, the thick line with points shows the desired rpm, the thin solid line shows the actual rpm using the present invention, the thin solid line with points shows the actual rpm using the prior art, and the thick solid line shows the load disturbance applied via the air conditioning (a/c) switch (acsw).

Also note that the data in FIG. 12 shows operation of the present invention when operating in the injector cut-out mode. I.e., here, the present invention is operating with some cylinders operating lean, and the remaining cylinders operating with air and substantially no injected fuel.

This operation is described more fully below. Applicants incorporate by reference the entire contents of U.S. application Ser. No. 10/064004 herein, which teaches a method for lean burn engine systems with variable displacement-like characteristics including injector cut-out.

Referring now to FIGS. 13A–13D, various configurations that can be used according to the present invention are described. In particular, FIG. 13A describes an engine 10 having a first group of cylinders 1310 and a second group of cylinders 1312. In this particular example, first and second groups 1310 and 1312 have four combustion chambers each. However, the groups can have different numbers of cylinders including just a single cylinder. And engine 10 need not be a V-engine, but also may be an in-line engine where the cylinder grouping do not correspond to engine banks.

Further, the cylinder groups need not include the same number of cylinders in each group.

First combustion chamber group 1310 is coupled to the first catalytic converter 1320. Upstream of catalyst 1320 and downstream of the first cylinder group 1310 is an exhaust gas oxygen sensor 1330. Downstream of catalyst 1320 is a second exhaust gas sensor 1332.

Similarly, second combustion chamber group 1312 is coupled to a second catalyst 1322. Upstream and downstream are exhaust gas oxygen sensors 1334 and 1336 respectively. Exhaust gas spilled from the first and second catalyst 1320 and 1322 merge in a Y-pipe configuration before entering downstream under body catalyst 1324. Also, exhaust gas oxygen sensors 1338 and 1340 are positioned upstream and downstream of catalyst 1324, respectively.

In one example embodiment, catalysts 1320 and 1322 are platinum and rhodium catalysts that retain oxidants when operating lean and release and reduce the retained oxidants when operating rich. Similarly, downstream underbody catalyst 1324 also operates to retain oxidants when operating lean and release and reduce retained oxidants when operating rich. Downstream catalyst 1324 is typically a catalyst including a precious metal and alkaline earth and alkaline metal and base metal oxide. In this particular example, downstream catalyst 1324 contains platinum and barium. Also, various other emission control devices could be used in the present invention, such as catalysts containing palladium or perovskites. Also, exhaust gas oxygen sensors 1330 to 1340 can be sensors of various types. For example, they can be linear oxygen sensors for providing an indication of air-fuel ratio across a broad range. Also, they can be switching type exhaust gas oxygen sensors that provide a switch in sensor output at the stoichiometric point. Further, the system can provide less than all of sensors 1330 to 1340, for example, only sensors 1330, 1334, and 1340.

Figure 13A:
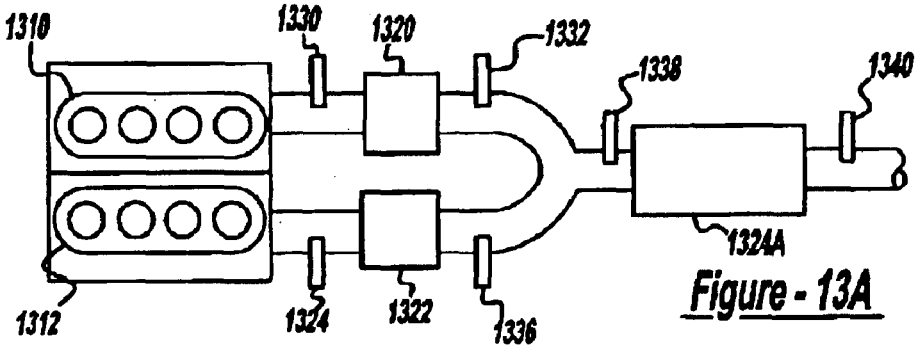
FIGS. 13A–D show different engine configurations for use with the present invention.

When the system of FIG. 13A is operated in the AIR/LEAN mode, first combustion group 1310 is operated without fuel injection and second combustion group 1312 is operated at a lean air-fuel ratio (typically leaner than about 18:1). Thus, in this case, and during this operation, sensors 1330 and 1332 see a substantially infinite air-fuel ratio. Alternatively, sensors 1334 and 1336 see essentially the air-fuel ratio combusted in the cylinders of group 1312 (other than for delays and filtering provided by the storage reduction catalysts 1322). Further, sensors 1338 and 1340 see a mixture of the substantially infinite air-fuel ratio from the first combustion chamber 1310 and the lean air-fuel ratio from the second combustion chamber group 1312.

As described in U.S. application Ser. No. 10/064004, diagnosis of sensors 1330 and 1332 can be performed when operating in the AIR/LEAN mode, if the sensors indicate an air-fuel ratio other than lean. Also, diagnostics of catalysts 1320 and 1322 are disabled when operating in the AIR/LEAN mode in the system of FIG. 13A, since the catalysts do not see a varying air-fuel ratio.

Figure 13B:
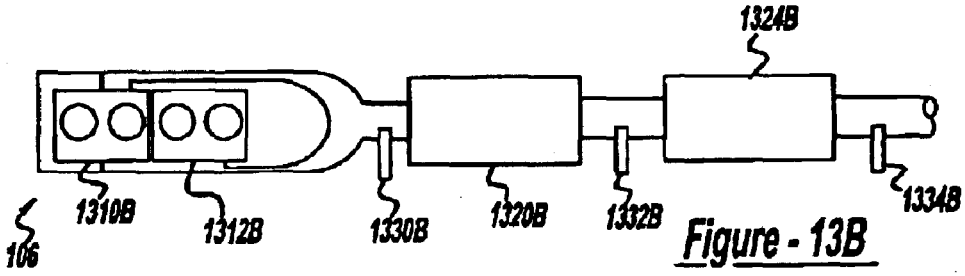

Referring now to FIG. 13B, engine 10B is shown with first and second cylinder groups 1310*b* and 1312*b*. In this example, an inline four-cylinder engine is shown where the combustion chamber groups are equally distributed. However, as described above herein with particular reference to FIG. 13A, the combustion chamber groups do not need to have equal number of cylinders. In this example, exhaust gases from both cylinder groups 1310*b* and 1312*b* merge in the exhaust manifold. Engine 10B is coupled to catalysts 1320*b*. Sensors 1330*b* and 1332*b* are positioned upstream and downstream of the upstream catalyst 1320*b*. Downstream catalyst 1324*b* is coupled to catalyst 1322*b*. In addition, a third exhaust gas oxygen sensor 1334*b* is positioned downstream of catalyst 1324*b*.

With regard to FIG. 13B, when the engine is operating in the AIR/LEAN mode, regardless of which cylinder group is operating lean and which is operating without fuel injection, all of the exhaust gas oxygen sensors and catalysts see a mixture of gases having a substantially infinite air-fuel ratio from group 1310B and gases having a lean air-fuel ratio from group 1312*b*.

Figure 13C:
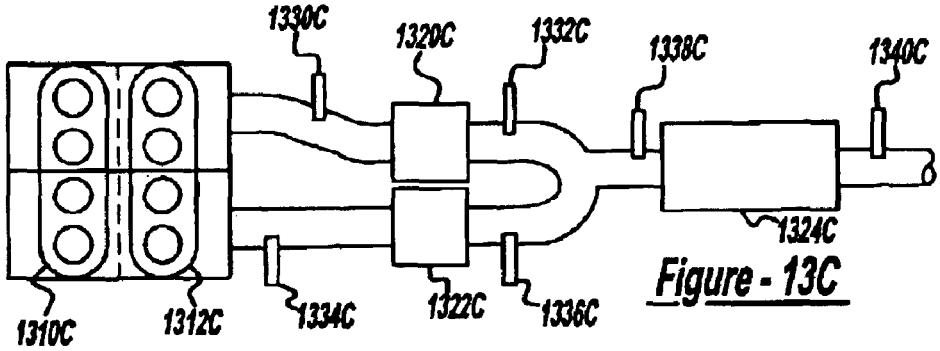

Referring now to FIG. 13C, a system similar to FIG. 13A is shown. However, in FIG. 13C, the cylinder groups 1310*c* and 1312*c* are distributed across engine banks so that each bank has some cylinders in a first group and some cylinders in a second group. Thus, in this example, two cylinders from group 1310*c* and two cylinders from group 1312*c* are coupled to catalysts 1320*c*. Similarly, two cylinders from group 1310*c* and 1312*c* are coupled to catalysts 1322*c*.

In the system of FIG. 13C, when the engine is operating in the AIR/LEAN mode, all of the sensors (1330*c* to 1340*c*) and all of the catalysts (1320*c* to 1324*c*) see a mixture of gases having a substantially infinite air-fuel ratio and gases having a lean air-fuel ratio, as previously described with particular reference to FIG. 13A.

Figure 13D:
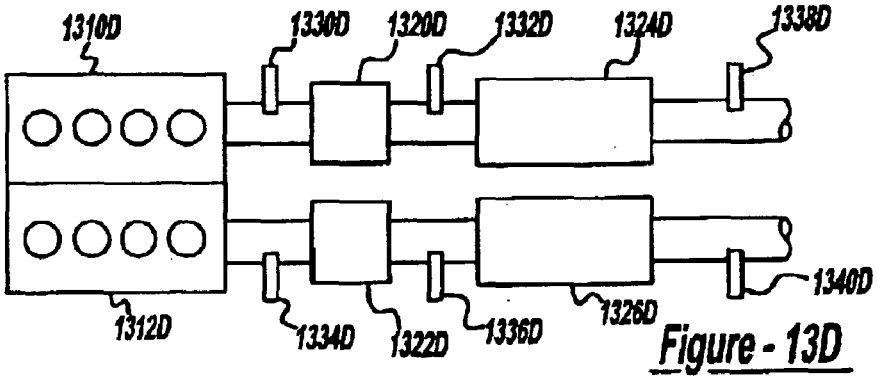

Referring now to FIG. 13D, yet another configuration is described. In this example, the first and second cylinder groups 1310*d* and 1312*d* have completely independent exhaust gas paths. Thus, when the engine is operating in the AIR/LEAN 1338*d* all see a gas with substantially infinitely lean air-fuel ratio. Alternatively, sensors 1334*d*, 1336*d*, and 1340*d* see a lean exhaust gas mixture (other than delay and filtering effects of catalysts 1322*d* and 1326*d*).

In general, the system of FIG. 13C is selected for a V-8 engine, where one bank of the V is coupled to catalyst 1320*c* and the other bank is coupled to catalyst 1322*c*, with the first and second cylinder groups being indicated by 1310*c* and 1312*c*. However, with a V-10 engine, typically the configuration of FIG. 13A or 13D is selected.

Figure 14:
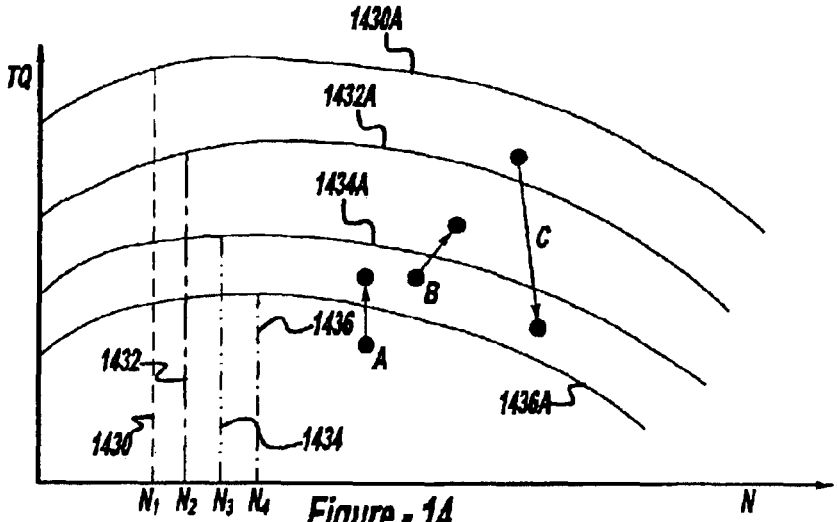
FIG. 14 show a graph illustrating different engine operating regions.
Figure 14A:
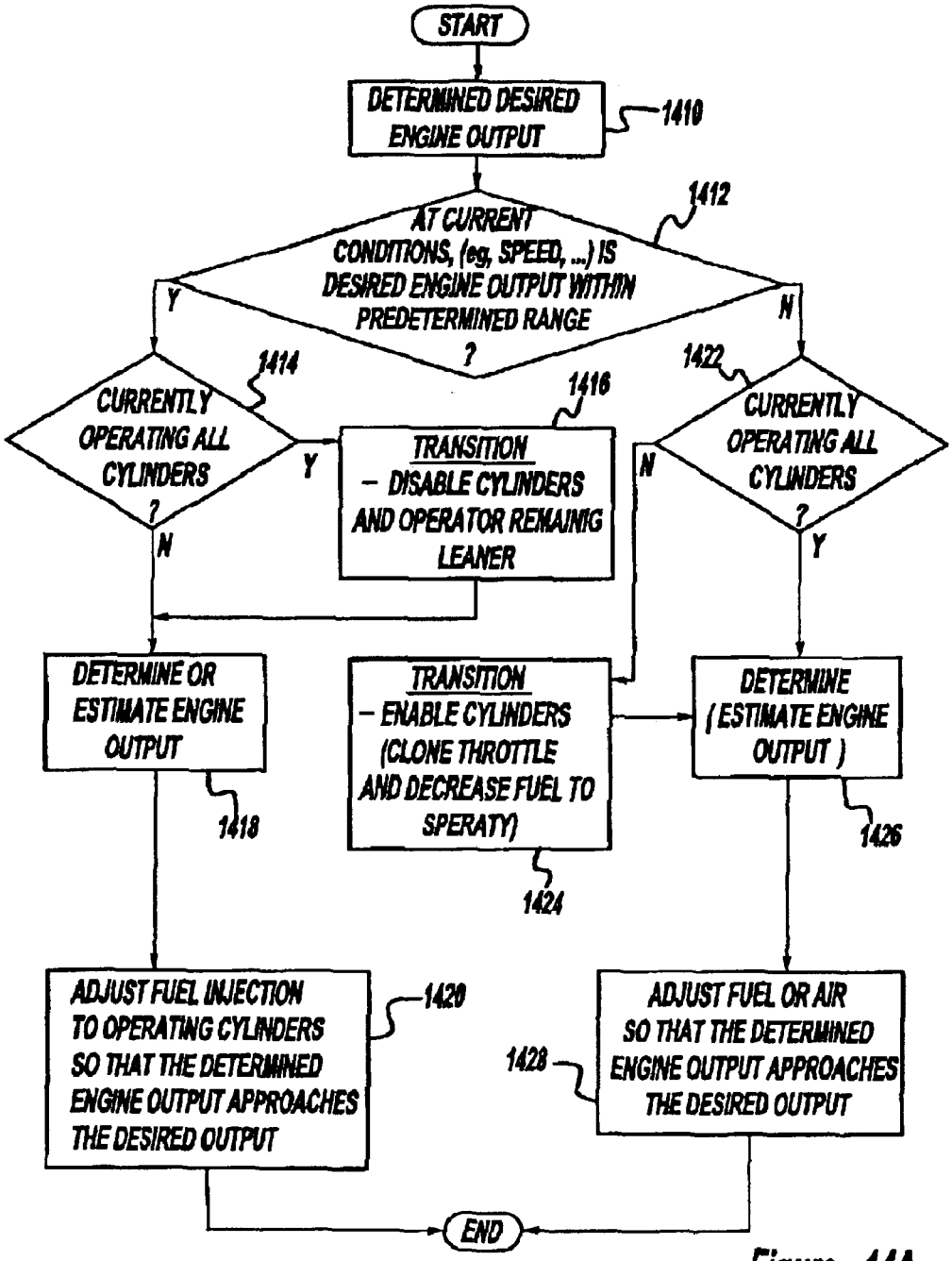

Referring now to FIG. 14A, a routine is described for controlling engine output and transitioning between engine operating modes. First, in step 1410, the routine determines a desired engine output. In this particular example, the desired engine output is a desired engine brake torque. Note that there are various methods for determining the desired engine output torque such as based on a desired wheel torque and gear ratio, based on a pedal position and engine speed, based on a pedal position and vehicle speed and gear ratio, or various other methods. Also note that various other desired engine output values could be used other than engine torque such as engine power or engine acceleration.

Next, in step 1412, the routine makes a determination as to whether at the current conditions the desired engine output is within a predetermined range. In this particular example, the routine determines whether the desired engine output is less than a predetermined engine output torque and whether current engine speed is within a predetermined speed range. Note that various other conditions can be used in this determination such as engine temperature, catalyst temperature, transition mode, transition gear ratio, and others. In other words, the routine determines in step 1412 which engine-operating mode is desired based on the desired engine output and current operating conditions. For example, there may be conditions where based on a desired engine output torque and engine speed, it is possible to operate with less than all the cylinders firing. However, due to other needs, such as purging fuel vapors or providing manifold vacuum, it is desired to operate with all cylinders firing. In other words, if manifold vacuum falls below a predetermined value, the engine is transitioned to operating with all cylinders combusting injected fuel. Alternatively, the transition can be called if pressure in the brake booster is below a predetermined value.

On the other hand, operation in the AIR/LEAN mode is permitted during fuel vapor purge if temperature of the catalyst is sufficient to oxidize the purged vapors which will pass through the non-conbusting cylinders.

Continuing with FIG. 14A, when the answer to step 1412 is yes, the routine determines in step 1414 as to whether all cylinders are currently operating. When answer to step 1414 is yes, a transition is scheduled to transition from firing all cylinders to disabling some cylinders and operating the remaining cylinders at a leaner air-fuel ratio than when all the cylinders were firing. The number of cylinders disabled is based on the desired engine output. The transition of step 1416, in one example, opens the throttle valve and increases fuel to the firing cylinders while disabling fuel to some of the cylinders. Thus, the engine transitions from performing combustion in all of the cylinders to operating in the hereinafter referred to AIR/LEAN MODE. In other words, to provide a smooth transition in engine torque, the fuel to the remaining cylinders is rapidly increased while at the same time the throttle valve is opened. In this way, it is possible to operate with some cylinders performing combustion at an air/fuel ratio leaner than if all of the cylinders were firing. Further, those remaining cylinders performing combustion operate at a higher engine load per cylinder than if all the cylinders were firing. In this way, a greater air-fuel lean limit is provided, thus allowing the engine to operate leaner and obtain additional fuel economy.

Next, in step 1418, the routine determines an estimate of actual engine output based on the number of cylinders combusting air and fuel. In this particular example, the routine determines an estimate of engine output torque. This estimate is based on various parameters such as engine speed, engine airflow, engine fuel injection amount, ignition timing, and engine temperature.

Next, in step 1420, the routine adjusts the fuel injection amount to the operating cylinders so that the determined engine output approaches the desired engine output. In other words, feedback control of engine output torque is provided by adjusting fuel injection amount to the subset of cylinders that are carrying out combustion.

Returning to step 1412 when the answer is no, the routine continues to step 1422 where a determination is made as to whether all cylinders are currently firing. When the answer to step 1422 is no, the routine continues to step 1424 where a transition is made from operating some of the cylinders to operating all of the cylinders. In particular, the throttle valve is closed and fuel injection to the already firing cylinders is decreased at the same time as fuel is added to the cylinders that were previously not combusting in air-fuel mixture. Then, in step 1426, the routine determines an estimate of engine output in a fashion similar to step 1418. However, in step 1426, the routine presumes that all cylinders are producing engine torque rather than in step 1418 where the routine discounted the engine output based on the number of cylinders not producing engine output.

Finally, in step 1428, the routine adjusts at least one of the fuel injection amount or the air to all the cylinders so that the determined engine output approaches a desired engine output. For example, when operating at stoichiometry, the routine can adjust the electronic throttle to control engine torque, and the fuel injection amount is adjusted to maintain the average air-fuel ratio at the desired stoichiometric value. Alternatively, if all the cylinders are operating lean of stoichiometry, the fuel injection amount to the cylinders can be adjusted to control engine torque while the throttle can be adjusted to control engine airflow and thus the air-fuel ratio to a desired lean air-fuel ratio. During rich operation of all the cylinders, the throttle is adjusted to control engine output torque and the fuel injection amount can be adjusted to control the rich air-fuel ratio to the desired air-fuel ratio.

FIG. 14A shows one example of engine mode scheduling and control. Various others can be used as is now described.

In particular, referring now to FIG. 14B, a graph is shown illustrating engine output versus engine speed. In this particular description, engine output is indicated by engine torque, but various other parameters could be used such as, for example, wheel torque, engine power, engine load, or others. The graph shows the maximum available torque that can be produced in each of four operating modes. Note that a percentage of available torque, or other suitable parameters, could be used in place of maximum available torque. The four operating modes in this embodiment include:

Operating some cylinders lean of stoichiometry and remaining cylinders with air pumping through and substantially no injected fuel (note: the throttle can be substantially open during this mode), illustrated as line 1430*a* in the example presented in FIG. 14B;

Operating some cylinders at stoichiometry, and the remaining cylinders pumping air with substantially no injected fuel (note: the throttle can be substantially open during this mode), shown as line 1434*a* in the example presented in FIG. 14B;

Operating all cylinders lean of stoichiometry (note: the throttle can be substantially open during this mode, shown as line 1432*a* in the example presented in FIG. 14B;

Operating all cylinders substantially at stoichiometry for maximum available engine torque, shown as line 1430*a* in the example presented in FIG. 14B.

Described above is one exemplary embodiment according to the present invention where an 8-cylinder engine is used and the cylinder groups are broken into two equal groups. However, various other configurations can be used according to the present invention. In particular, engines of various cylinder numbers can be used, and the cylinder groups can be broken down into unequal groups as well as further broken down to allow for additional operating modes. For the example presented in FIG. 14B in which a V-8 engine is used, lines 1436*a* shows operation with 4 cylinders operating with air and substantially no fuel, lines 1434*a* shows operation with four cylinders operating at stoichiometry and four cylinders operating with air, line 1432*a* shows 8 cylinders operating lean, and line 1430*a* shows 8 cylinders operating at stoichiometry.

The above-described graph illustrates the range of available torques in each of the described modes. In particular, for any of the described modes, the available engine output torque is any torque less than the maximum amount illustrated by the graph. Also note that in any mode where the overall mixture air-fuel ratio is lean of stoichiometry, the engine can periodically switch to operating all of the cylinders stoichiometric or rich. This is done to reduce the stored oxidants (e.g., NOx) in the emission control device(s). For example, this transition can be triggered based on the amount of stored NOx in the emission control device(s), or the amount of NOx exiting the emission control device(s), or the amount of NOx in the tailpipe per distance traveled (mile) of the vehicle.

To illustrate operation among these various modes, several examples of operation are described. The following are simply exemplary descriptions of many that can be made, and are not the only modes of operation according to the present invention. As a first example, consider operation of the engine along trajectory A. In this case, the engine initially is operating with four cylinders lean of stoichiometry, and four cylinders pumping air with substantially no injected fuel. Then, in response to operating conditions, it is desired to change engine operation along trajectory A. In this case, it is desired to change engine operation to operating with four cylinders operating at substantially stoichiometric combustion, and four cylinders pumping air with substantially no injected fuel. In this case, additional fuel is added to the combusting cylinders to decrease air-fuel ratio toward stoichiometry, and correspondingly increase engine torque.

As a second example, consider trajectory labeled B. In this case, the engine begins by operating with four cylinders combusting at substantially stoichiometry, and the remaining four cylinders pumping air with substantially no injected fuel. Then, in response to operating conditions, engine speed changes and is desired to increase engine torque. In response to this, all cylinders are enabled to combust air and fuel at a lean air-fuel ratio. In this way, it is possible to increase engine output while providing lean operation.

As a third example, consider the trajectory labeled C. In this example, the engine is operating with all cylinders combusting at substantially stoichiometry. In response to a decrease in desired engine torque, four cylinders are disabled to provide the engine output.

Continuing with FIG. 14B, and lines 1430–1436 in particular, an illustration of the engine output, or torque, operation for each of the four exemplary modes is now described. For example, at engine speed N1, line 1430 shows the available engine output or torque output that is available when operating in the 8-cylinder stoichiometric mode. As another example, line 1432 indicates the available engine output or torque output available when operating in the 8-cylinder lean mode at engine speed N2. When operating in the 4-cylinder stoichiometric and 4-cylinder air mode, line 1434 shows the available engine output or torque output available when operating at engine speed N3. And, finally, when operating in the 4-cylinder lean, 4-cylinder air mode, line 1436 indicates the available engine or torque output when operating at engine speed N4.

Figure 15:
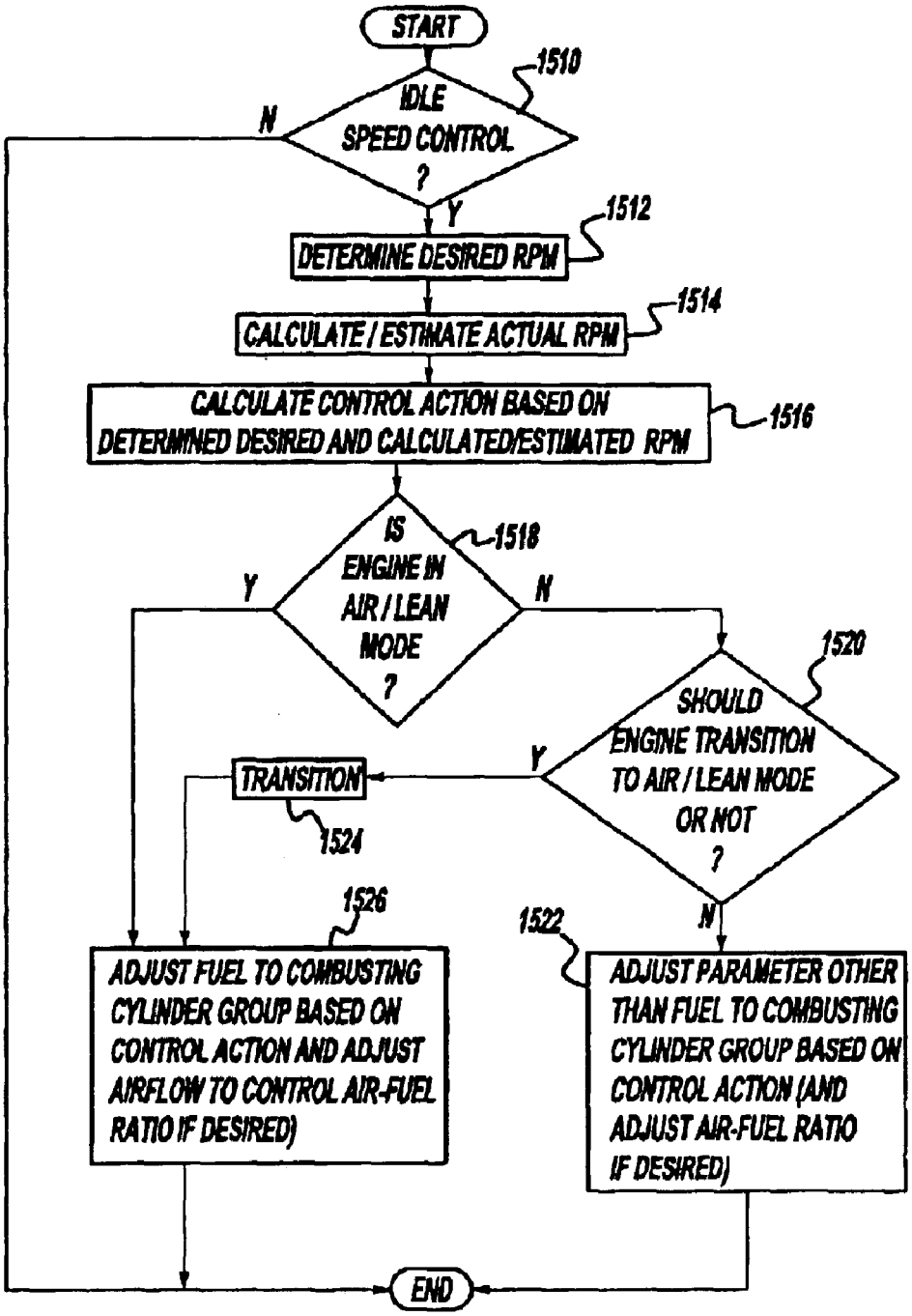

Referring now to FIG. 15, a routine for controlling engine idle speed is described. First, in step 1510, a determination is made as to whether idle speed control is required. In particular, the routine determines whether engine speed is within a predetermined idle speed control range, whether the pedal position is depressed less than a predetermined amount, whether vehicle speed is less than a predetermined value, and other indications that idle speed control is required. When the answer to step 1510 is yes, the routine determines a desired engine speed in step 1512. This desired engine speed is based on various factors, such as: engine coolant temperature, time since engine start, position of the gear selector (for example, a higher engine speed is usually set when the transmission is in neutral compared with in drive), and accessory status such as air-conditioning, and catalyst temperature. In particular, desired engine speed may be increased to provide additional heat to increase temperature of the catalyst during engine warm up conditions.

Then, in step 1514, the routine determines actual engine speed. There are various methods for determining actual engine speed. For example, engine speed can be measured from an engine speed sensor coupled to the engine crankshaft. Alternatively, engine speed can be estimated based on other sensors such as a camshaft position sensor and time. Then, in step 1516, the routine calculates a control action based on the determined desired speed and measured engine speed. For example, a feed forward plus feed back proportional/integral controller can be used. Alternatively, various other control algorithms can be used so that the actual engine speed approaches the desired speed.

Next, in step 1518, the routine determines whether the engine is currently operating in the AIR/LEAN mode. When the answer to step 1518 is no, the routine continues to step 1520.

Referring now to step 1520, a determination is made as to whether the engine should transition to a mode with some cylinders operating lean and other cylinders operating without injected fuel, referred to as AIR/LEAN mode. This determination can be made based on various factors. For example, various conditions may be occurring where it is desired to remain with all cylinders operating such as, for example, fuel vapor purging, adaptive air/fuel ratio learning, a request for higher engine output by the driver, operating all cylinders rich to release and reduce oxidants stored in the emission control device, to increase exhaust and catalyst temperature to remove contaminants such as sulfur, operating to increase or maintain exhaust gas temperature to control any emission control device to a desired temperature or to lower emission control device temperature due to over-temperature condition. In addition, the above-described conditions may occur not only when all the cylinders are operating or all the cylinders are operating at the same air/fuel ratio, but also under other operating conditions such as some cylinders operating at stoichiometry and others operating rich, some cylinders operating without fuel and just air, and other cylinders operating rich, or conditions where some cylinders are operating at a first air/fuel ratio and other cylinders are operating at a second different air/fuel ratio. In any event, these conditions may require transitions out of, or prevent operation in, the AIR/LEAN operating mode.

Referring now to step 1522 of FIG. 15, a parameter other than fuel to the second cylinder group is adjusted to control engine output and thereby control engine speed. For example, if the engine is operating with all of the cylinder groups lean, then the fuel injected to all of the cylinder groups is adjusted based on the determined control action. Alternatively, if the engine is operating in a stoichiometric mode with all of the cylinders operating at stoichiometry, then engine output and thereby engine speed is adjusted by adjusting the throttle or an air bypass valve. Further, in the stoichiometric mode, the stoichiometric air/fuel ratio of all the cylinders is adjusted by individually adjusting the fuel injected to the cylinders based on the desired air/fuel ratio and the measured air/fuel ratio from the exhaust gas oxygen sensor in the exhaust path.

When the answer to step 1520 is yes, the routine continues to step 1524 and the engine is transitioned from operating all the cylinders to operating in the AIR/LEAN mode with some of the cylinders operating lean and other cylinders operating without injected fuel.

From step 1524 or when the answer to step 1518 is yes, the routine continues to step 1526 and idle speed is controlled while operating in the AIR/LEAN mode. Referring now to step 1526 of FIG. 15, the fuel provided to the cylinder group combusting an air/fuel mixture is adjusted based on the determined control action and the method described in FIG. 3. Thus, the engine idle speed is controlled by adjusting fuel to less than all of the cylinder groups and operating with some cylinders having no injected fuel.

Further, if it is desired to control the air/fuel ratio of the combusting cylinders, or the overall air/fuel ratio of the mixture of pure air and combusted air and fuel based on, for example, an exhaust gas oxygen sensor, then the throttle is adjusted based on the desired air/fuel ratio and the measured air/fuel ratio. In this way, fuel to the combusting cylinders is adjusted to adjust engine output while air/fuel ratio is controlled by adjusting air flow. Note, in this way, the throttle can be used to keep the air-fuel ratio of the combusting cylinders within a preselected range to provide good combustibility and reduced pumping work.

Thus, according to the present invention, when operating in the AIR/LEAN mode, fuel injected to the cylinders combusting a lean air-fuel mixture is adjusted so that actual engine speed approaches a desired engine speed, while some of the cylinders operate without injected fuel. Alternatively, when the engine is not operating in the AIR/LEAN mode, at least one of the air and fuel provided all the cylinders is adjusted to control engine speed to approach the desired engine speed.

Thus, throughout most lean idle operation of the engine according to the present invention, the air-fuel ratio is maintained at a value greater than 1.0. The total spark advance, saftot, is maintained at MBT for optimal performance and fuel economy. When rpmerr is increases past a threshold, the air-fuel ratio is adjusted to meet the desired rpm change by increasing the fuel quantity. This is shown as a decrease towards 1.0. When the load disturbance is rejected, the air-fuel value can be increased gradually via the strategy discussed previously, due to an airflow increase. This airflow increase serves to increase, lambse, and the engine returns to a more lean operating condition. When a load decrease condition is desired, as indicated by an rpmerr value less than another threshold, a change in total spark advance, or saftot, is used to meet the desired operating condition. As shown, the air-fuel ratio is maintained at a lean value close to the lean misfire limit.

We claim:

1. A method for controlling a lean burn engine, comprising:

calculating a desired speed;

operating more lean than a first predetermined lean air/fuel ratio and producing an engine output;

increasing said engine output to maintain said desired speed by operating less lean than said first air/fuel ratio; and decreasing said engine output to maintain said desired speed by retarding ignition timing from a preselected timing while operating more lean than said first lean air/fuel ratio.

2. The method of claim 1 wherein said preselected timing is the optimal torque ignition timing.

3. The method of claim 1 wherein said calculated desired speed is based on temperature.

4. The method of claim 1 wherein said calculated desired speed is based on time since engine start.

5. The method of claim 1 wherein said calculating a desired engine speed is based on speed error.

6. The method of claim 1 wherein said calculated desired speed is based on a desired vehicle speed.

7. A method for controlling a lean burn engine, comprising:

calculating a desired engine speed based on one or more of temperature, time since engine start, or engine speed error;

operating more lean than a first predetermined lean air/fuel ratio and producing an engine output;

increasing said engine output to maintain said desired engine speed by operating less lean than said first air/fuel ratio while maintaining ignition timing less retarded from optimal torque timing than a preselected timing; and decreasing said engine output to maintain said desired engine speed by operating more lean than said first air/fuel ratio and maintaining ignition timing more retarded from optimal torque timing than said preselected timing.

8. A method for controlling a lean burn engine, comprising:

calculating a desired engine speed;

determining the engine torque required to achieve said desired engine speed;

operating more lean than a first predetermined lean air/fuel ratio and producing said engine torque;

increasing said engine torque to maintain said desired engine speed by operating less lean than said first air/fuel ratio; and decreasing said engine torque to maintain said desired engine speed by operating more lean than said first lean air/fuel ratio and retarding ignition timing from a preselected timing.

9. The method of claim 8 wherein said preselected timing is the optimal torque ignition timing.

10. The method of claim 8 wherein said calculated desired speed is based on temperature.

11. The method of claim 8 wherein said calculated desired speed is based on time since engine start.

12. The method of claim 8 wherein said calculating a desired engine speed is based on speed error.

13. The method of claim 8 wherein said calculated desired speed is based on a desired vehicle speed.

* * * * *